United States Patent [19]

Reichstahler

[11] Patent Number: 4,833,867

[45] Date of Patent: May 30, 1989

[54] APPARATUS FOR PACKAGING PRODUCTS

[75] Inventor: Liesel Reichstahler, Amsterdam, Netherlands

[73] Assignee: Audion Elektro B.V., Amsterdam, Netherlands

[21] Appl. No.: 110,019

[22] Filed: Oct. 19, 1987

[30] Foreign Application Priority Data

Nov. 6, 1986 [NL] Netherlands ..... 8602817

[51] Int. Cl.[4] ..... B65B 43/00

[52] U.S. Cl. ..... 53/567; 53/385; 493/238

[58] Field of Search ..... 53/558, 567, 386, 385, 53/384, 570; 493/230, 227, 234, 238

[56] References Cited

U.S. PATENT DOCUMENTS

| | | | |
|---|---|---|---|
| 3,269,087 | 8/1966 | Cloud et al. | 53/385 X |
| 3,948,015 | 4/1976 | Lerner | 53/385 X |
| 3,948,019 | 4/1976 | Döring et al. | 53/567 X |
| 4,334,399 | 6/1982 | Onishi | 53/385 X |
| 4,586,318 | 5/1986 | Litt et al. | 53/567 X |

FOREIGN PATENT DOCUMENTS 2440579 3/1975 Fed. Rep. of Germany ..... 493/238

*Primary Examiner*—James F. Coan

*Attorney, Agent, or Firm*—Wolf, Greenfield & Sacks

[57] ABSTRACT

An apparatus for packaging products in a bag of plastic material comprises means (3–15) for transporting a continuous, flat, tube-like material web (2). The web 2 is subsequently transported along a fist sealing unit (16) for applying a seal between the upper and under layers (17, 18) of the material web, a perforating knife (19) for making a tearing perforation in the upper and under layers of the material web seen in transport direction directly behind the seal, a tearing unit (20) for tearing open the perforation in the upper layer of the material web, a separating unit (21) for moving the upper layer away from the under layer at the location of the torn perforation, a filling station (22) for filling the thus formed bag (23) still contained in the material web with the product to be packed, a second sealing unit (24) for applying a seal between the upper and under layers of the material web seen in transport direction directly behind the perforation, and a tearing-off unit (25) for tearing off the filled bag of the material web.

26 Claims, 4 Drawing Sheets

APPARATUS FOR PACKAGING PRODUCTS

The invention relates to an apparatus for packaging products in a bag of plastic material, such as for example polyethylene.

With the usual apparatus of this type a flat tube-like material web is used, in which at fixed intermediate distances a seal between the upper and under layer of the material web and directly behind said seal a perforation are applied. Thereby, this known apparatus is only suitable for packaging products in bags with standard size.

With another known apparatus of this type a material web consisting of one layer is used which is folded into a tube in the apparatus, wherein a longitudinal seal is applied whereas further in correspondence with the desired size of the bag two lateral seals are applied. The bag is filled during the forming of the tube. This known apparatus is very complicated and changing the size of the bag is very cumbersome.

The invention aims to provide an apparatus of the above-mentioned type which has a simple construction and with which a bag with any desired size can be obtained in a simple manner.

To this end the apparatus according to the invention is characterized by means for transporting a continuous, flat, tube-like material web subsequently along a first sealing unit for applying a seal between the upper and under layers of the material web, a perforating knife for making a tearing perforation in the upper and under layers of the material web seen in transport direction directly behind the seal, a tearing unit for tearing open the perforation in the upper layer of the material web, a separating unit for moving the upper layer away from the under layer at the location of the torn perforation, a filling station for filling the thus formed bag still contained in the material web with the product to be packed, a second sealing unit for applying a seal between the upper and under layers of the material web seen in transport direction directly behind the perforation, and a tearing-off unit for tearing off the filled bag of the material web.

In this manner an apparatus for packaging products is obtained, wherein a bag of any desired size is possible because a tube-like material web is used in which seals or perforations are not yet made and wherein the desired size of the bag can easily be determined by transporting a corresponding length of the material web along the first sealing unit each time after applying a seal by the first sealing unit.

Further favorable embodiments appear from the subclaims which are further explained in the following description.

The invention will be further explained by reference to the drawings in which an embodiment of the apparatus according to the invention is schematically shown.

FIG. 1 schematically shows an embodiment of the apparatus according to the invention partially in side view and partially in section.

Figure 1:
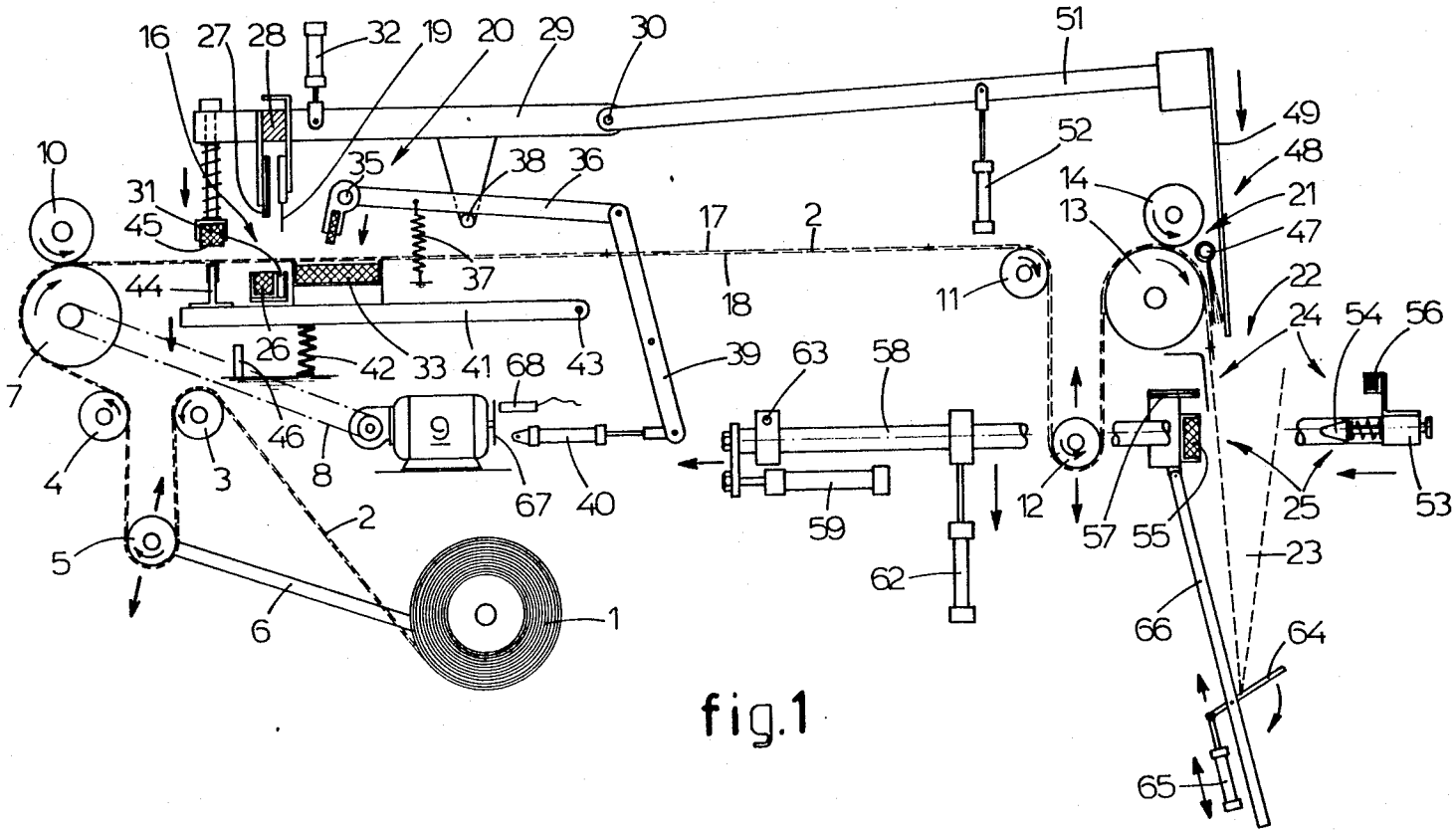
Figure 7:
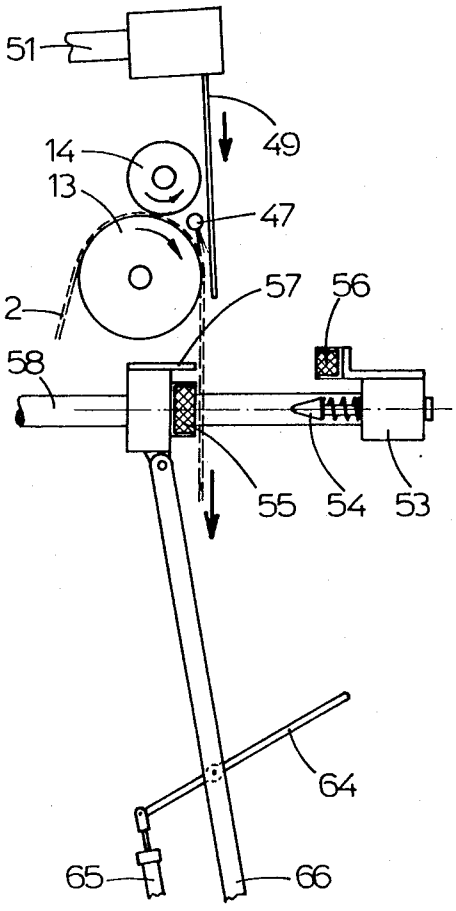
Figure 6:
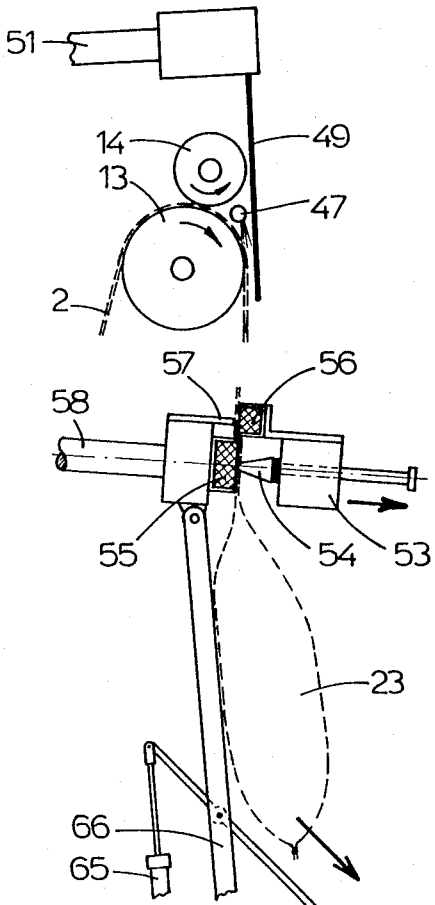
Figure 5:
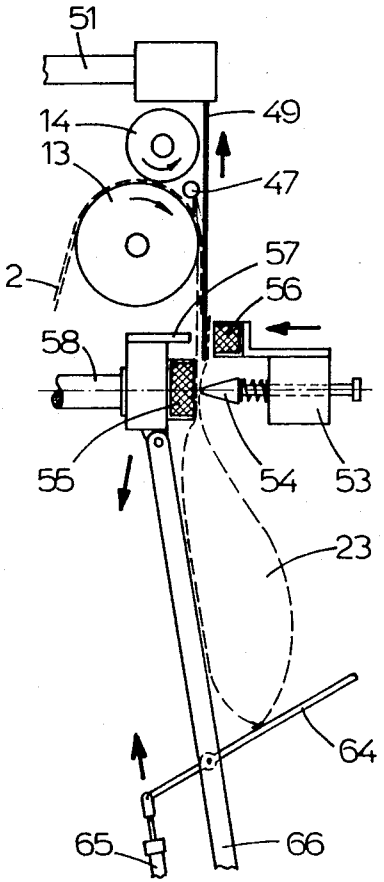

FIGS. 5, 6, and 7 show the operation of the part of the apparatus of FIG. 1 comprising the second sealing unit and the tearing-off unit.

Referring to FIG. 1 there is shown an apparatus for packaging products in a bag of plastic material, such as for example polyethylene. In order to clearly show the parts of the apparatus which are relevant for its operation, the frame of the apparatus is not shown.

In this frame a roll 1 is rotatably supported, which roll 1 consists of a continuous flat tube-like material web 2 which is transported through the apparatus 1. The material web 2 first passes three rollers 3, 4 and 5, of which the rollers 3 and 4 are stationary mounted in the frame and the roller 5 is born between two arms 6, only one of which being shown in FIG. 1. These arms 6 actuate in a usual manner a braking mechanism for the material web roll 1.

Figure 2:
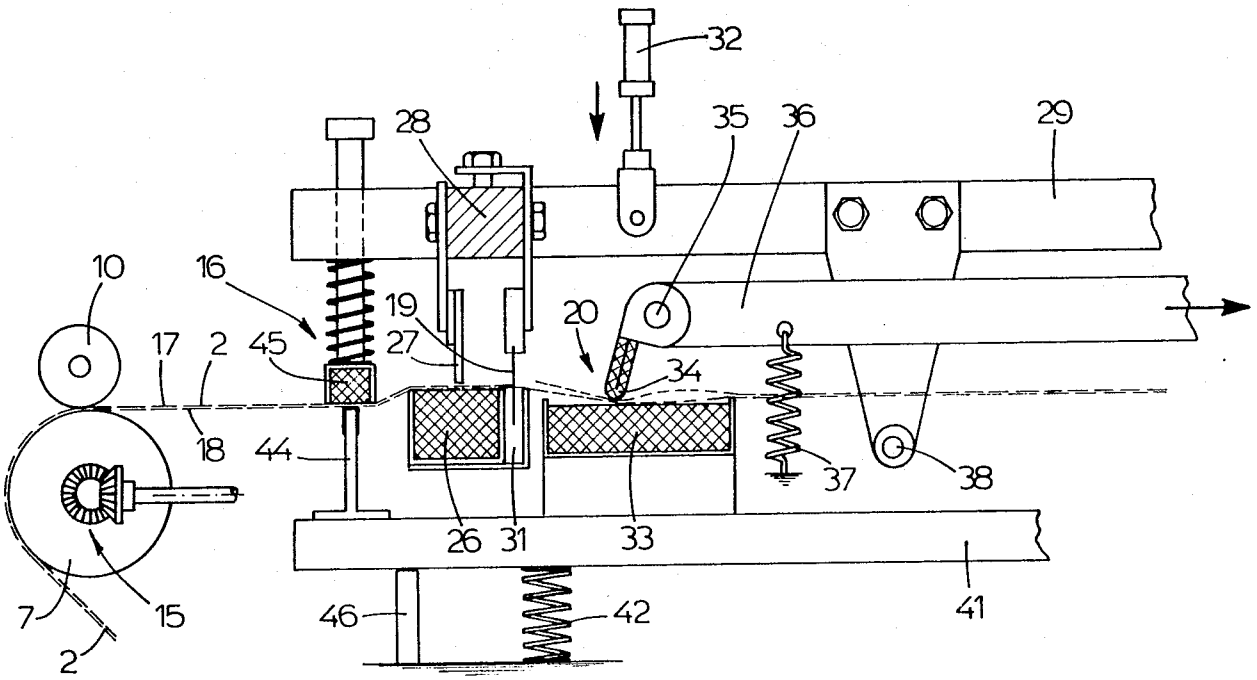
FIG. 2 shows on a larger scale a part of the apparatus of FIG. 1, wherein the first sealing unit, the perforating knife and the tearing unit are shown.

From the roller 4 the material web 2 extends via a transport roller 7 which is drivable by a motor 9 through a chain 8 or the like. The transport roller 7 co-operates with a pressure roller 10. From the rollers 7, 10 the material web 2 extends substantially horizontally through the apparatus to a supporting roller 1, subsequently via a return roller 12 adjustable in vertical direction towards a second transport roller 13 co-operating with a pressure roller 14. From the second transport roller 13 the material web 2 extends in a downward direction. The second transport roller 13 is coupled with the first transport roller 7 with a transmission ratio 1:1. The diameter of the second transport roller 13 is slightly larger than the same of the first transport roller so that the material web 2 is always maintained under tension between both said transport rollers 7 and 13. Between the shaft of the second transport roller 13 driven through the coupling with the first transport roller 7, and said second transport roller 13 a coupling is provided which is only active in the transport direction, so that the second transport roller 13 can slip with respect to its shaft in the opposite direction. FIG. 2 only shows a rectangular transmission 15 of this coupling between said both transport rollers 7 and 13.

The material web 2 passes in the described apparatus subsequently a first sealing unit 16 for applying a seal between the upper layer 17 and the under layer 18 of the material web 2, a perforating knife 19 which is provided with sharply pointed teeth not shown in the drawings and is adapted for applying a tearing perforation in the layers 17 and 18 of the material web. Then a tearing unit 20 is provided for tearing open the perforation in the upper layer 17 of the material web 2. Behind the second transport roller 13 a separating unit 21 is provided which is adapted to move away the torn-open upper layer 17 form the under layer 18. The separating unit 21 is followed by a filling station 22 for filling the formed bag 23 still contained in the material web 2 with the product to be packaged. Filling the bag 23 may be done manually or by means of a suitable automatic filling device. Finally a second sealing unit 24 is mounted for applying a seal between the upper layer 17 and the under layer 18 directly behind the applied perforation whereby the formed bag 23 is closed. At the sealing unit 24, a clamping unit 25 is also provided which before applying the seal clamps closed the upper side of the bag 23 and also operates as a tearing-off unit for tearing off the filled bag 23 of the material web 2.

The first sealing unit 16 is provided with a pressure beam 26 stationary mounted in the frame of the apparatus and consisting of silicon rubber in a usual manner.

Further the sealing unit 16 comprises a sealing beam 27 which during operation of the apparatus is maintained on a sealing temperature suitable for the respective plastic material by a thermostatic control not further described. The sealing beam 27 is mounted on a support 28 which is fixed between two pivot arms 29. The pivot arms 29 are pivotably mounted at the location 30. The support 28 further carries the perforating knife 19. For this perforating knife 19 a U-shaped trough 31 is provided beside the pressure beam 26. The sealing beam 27 and the perforating knife 19 are movable up and down with the pivot arms 29 by means of a drive means 32.

The tearing unit 20 has a lower beam 33 which mainly consists of rubber. The tearing unit 20 further has a plurality of fingers 34 (see FIG. 2) covered with rubber and together forming an upper beam and each being rotatable between an active position shown in the drawing in which the fingers 34 are directed to the lower beam 33 and an inactive position. Thereby a plurality of fingers 34 can be brought in the active position in correspondence with the width of the material web 2.

As further indicated in FIG. 2, the fingers 34 are rotatable mounted on a shaft 35 mounted between two pivot arms 36. The pivot arms 36 are movable up and down in that the pivot arms 36 are pulled down by a spring 37 when the pivot arms 29 move downward and are taken along by a carrier 38 fixed to the pivot arms 29 when the pivot arms 29 move upward.

The pivot arms 36 further are movable backward and forward because the ends directed away from the fingers 34 each are connected to a lever 39. The levers 39 are operable by a drive means 40. When the drive means 40 is energized in the position of the pivot arms 36 shown in FIG. 2, the fingers 34 in the active position will pull along the upper layer 17, whereby the perforation in the upper layer 17 made by the perforating knife 19 tears open.

The lower beam 33 of the tearing unit 20 is mounted between two further pivot arms 41 which are pivotable around a rotation point 43 against the action of a compression spring 42. A pressure strip 44 is mounted on the pivot arms 41 seen in transport direction before the pressure beam 26, the upper side of the pressure strip 44 being coated with teflon. The pivot arms 29 carry a pressure beam 45 cooperating with the pressure strip 44 and consisting mainly of rubber. The pressure beam is spring mounted in the pivot arms 29.

In the position of FIG. 1 in which all pivot arms 29, 36 and 41 are pivoted upwards, the upper sides of the pressure strip 44 and the lower beam 33 ly above the pressure beam 26, whereas in the position of FIG. 2 in which said pivot arms are pivoted downwards, the upper sides of the pressure strip 44 and of the lower beam 33 ly slightly below the upper side of the pressure beam 26. The lower position of the pivot arms 41 is determined by a stop 46. In this manner it is obtained that the material web 2 is tightened over the pressure beam 26 so that a seal of a high quality can be applied. As the teeth of the perforating knife 19 project downwardly with respect to the sealing beam 27, the under layer 18 can slide over the pressure strip 44 during applying the perforation due to the teflon coating. Thereby the under layer 18 will be perforated less than the upper layer 17, so that during tearing open the perforation in the upper layer 17 there is no risk that the perforation in the under layer 18 will also be torn open. The backward and forward movement of the fingers 34 for tearing open the upper layer 17 takes place in the position of FIG. 2 as soon as the sealing beam 27 presses the material web 2 upon the pressure beam 26.

When a perforation in the upper layer 17 which is torn open, passes the separating unit 21 disposed seen in transport direction directly behind the second transport roller 13, the upper layer 17 is moved away from the under layer 18. In the embodiment shown the separating unit 21 comprises a tube 47 extending laterally to the transport direction and having discharge openings distributed along the length of the tube and substantially tangentially directed with respect to the second transport roller 13 at the location where the material web 2 leaves the transport roller 13. The tube 47 is connected to a source of overpressure not shown so that the upper layer 17 is blown away from the under layer 18. The discharge openings lying outside the width of the material web 2 are closed by a sleeve slidable on the tube 47 and not shown in the drawings.

Figure 4:
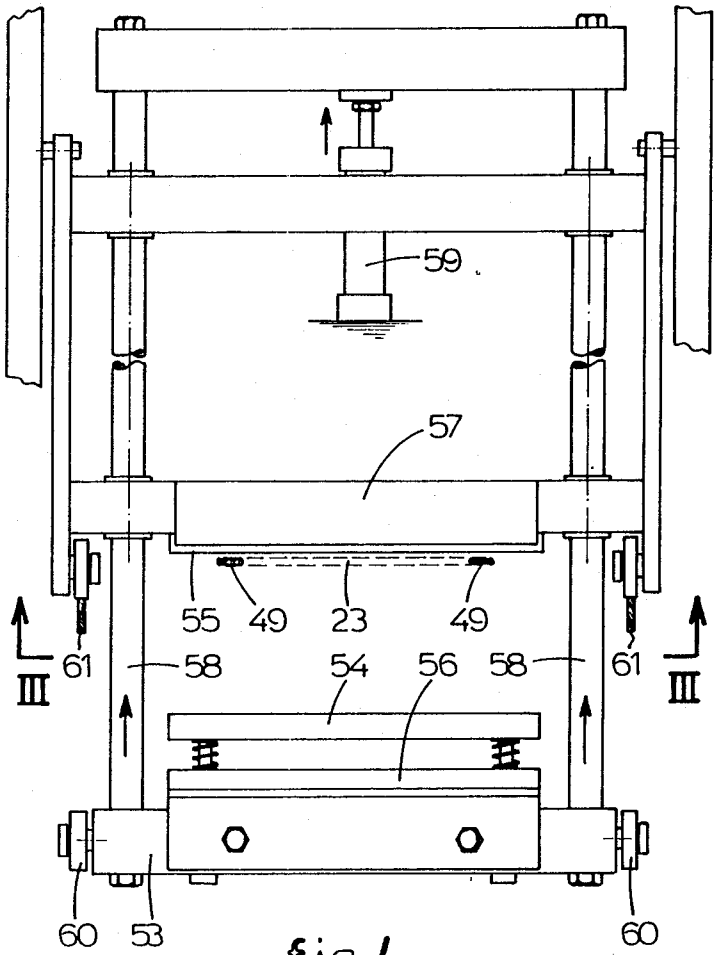
FIG. 4 is a top view of the filling station of the apparatus of FIG. 1.
Figure 3:
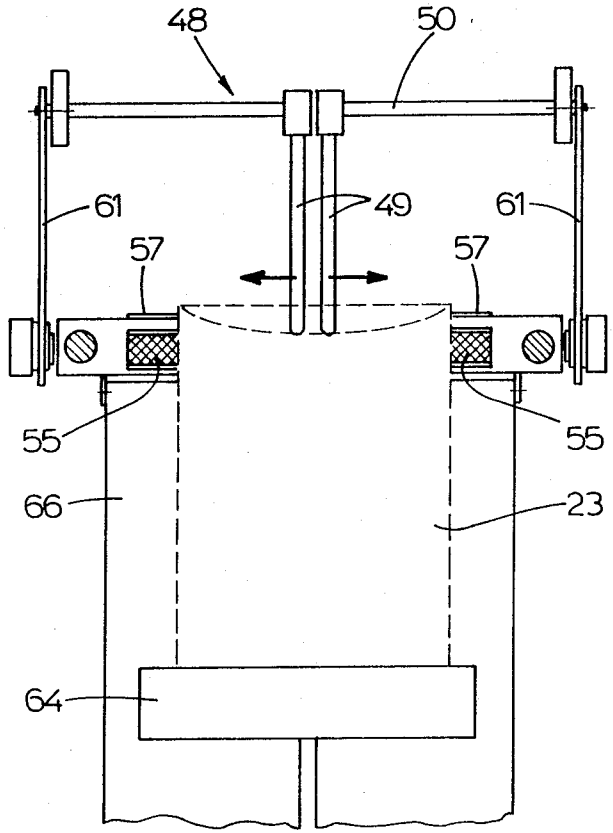
FIG. 3 is a section according to the line III—III of FIG. 4.

The bag 23 now arrived in the filling station 22 and opened by the separating unit 21, may now be filled manually or by an automatic filling device. After filling the bag 23 with the product to be packaged, the operator provides a filling signal in case of manually filling and in case of an automatic filling device the filling signal will be delivered by the filling device, which filling signal energizes a stretching unit 48 mounted at the filling station 22. This stretching unit 48 is provided with two pins 49 slidably mounted on a support rod 50 lateral to the transport direction. The support rod 50 is mounted between two pivot arms 51 rotatably born at 30. The pivot arms 51 are movable up and down by a drive means 52. In the lower position of the pivot arms 51 the pins 49 project into the open upper side of the bag 23 as shown in FIG. 3. In the upper position of the pivot arms 51 shown in FIG. 1, the pins 49 ly at a distance above the bag 23. When the pins 49 are inserted in the open upper side of the bag, they are shifted away from each other by a drive means not shown, whereby the position of FIG. 4 is reached, in which the open upper side of the bag 23 is stretched. In this stretched position of the bag 23 the second sealing unit 24 can apply a seal between the upper layer 17 and the under layer 18, whereby the bag is closed. In order to apply said seal the clamping unit 25 first clamps the stretched upper side of the bag.

The clamping unit 25 is provided with a clamping strip 54 spring mounted on a support beam 53, and with a cooperating rubber pressure strip 55. The support beam 53 also supports a pressure beam 56 of the second sealing unit 24 consisting of silicon rubber. Above the pressure strip 55 of the clamping unit 25 a sealing beam 57 of the second sealing unit 24 is mounted. Said sealing beam 57 is maintained at a sealing temperature suitable for the respective plastic material by a thermostatic control during operation of the apparatus in a conventional manner.

The support beam 53 is mounted between two rods 58 movable backward and forward by a drive means 59. In the position of FIG. 1 the clamping strip 54 projects with respect to the pressure beam 56 in the direction of the material web 2 as can also be seen in FIG. 4.

The operation of the second sealing unit 24 and the clamping unit 25 will be further explained by reference to FIGS. 5–7.

When the pins 49 have stretched the upper side of the bag 23, the drive means 59 moves the support beam 53 in the direction of the clamping strip 55 and the sealing beam 57. Because the clamping strip 54 protrudes, it clamps the stretched upper side of the bag 23 against the pressure strip 55. The drive means 59 cannot move the support beam 53 further because stop rollers 60 abut stop strips 61 attached to the pivot arms 51. As soon as the clamping strip 54 has clamped the upper side of the bag 23 on the pressure strip 25, the drive means 52 moves the pivot arms 51 upwardly so that the pins 49 are drawn out of the upper side of the bag 23 whereby the stop strips 61 are also drawn away, so that the drive means 59 can move the support beam 53 further towards the bag 23 and the pressure beam 56 presses the upper side of the bag 23 on the sealing beam 57. Thereby the upper side of the bag 23 will be sealed.

The rods 58 can be provided up and down around a rotation point 63 by a drive means 62. This drive means 62 is energized as soon as the pressure beam 56 presses the bag 23 against the sealing beam 57, whereby the rods 58 move the support beam 53 and the sealing beam 57 and pressure strip 55 also mounted between said rods 58 downwards and the perforation in the under layer 18 will be torn. Thereby the sealed bag 23 will be disengaged from the material web 2. Further a support board 64 will be pivoted away by a drive means 65 so that the disengaged bag 23 slides downward along a slideway 66 and is received in a box for example.

During tearing off the bag 23 the material web 2 is held by the second transport roller 13 because this second transport roller cannot slip in transport direction with respect to its driven shaft as already noted above.

The described apparatus is controlled by a control unit not further shown which controls the motor 9 for a stepwise transport of the material web 2 along a distance corresponding with the desired bag length. This bag length is adjustable by means of an adjusting device not shown. The transported length of the material web 2 is determined by the control unit by measuring the angular rotation of the motor 9. To this end a disc 67 can for example be mounted on the shaft of the motor 9 which is provided with a plurality of holes uniformly distributed along its circumference, whereas a capacitive transducer 68 is mounted adjacent the disc 67 and delivers a signal to the control unit each time a hole passes. Each time after transporting the desired web length the control unit operates the drive means 32 so that the first sealing unit 16 applies a seal and the perforating knife 19 forms a perforation in the upper and under layers 17, 18 of the material web 2. At the same time an open bag 23 is present at the filling station 22 which bag can be filled. The return roller 12 can be adjusted in such a manner that the intermediate length of the material web 2 lies tightened between both transport rollers 7 and 13.

When the filling signal indicates that the filling of the bag 23 is finished, the control unit puts into operation the stretching unit 48 and subsequently energizes the drive means 59, 62 and 65 whereby the bag is sealed and torn off the material web 2. Thereafter the control unit may start a next cycle.

As an alternative for measuring the transported web length a reading device may be mounted above the material web 2 between both transport rollers 7 and 13, which reading device delivers a signal to the control unit when a print on the material web 2 passes. After receipt of this signal the control unit stops the transport of the material web 2 in order to carry out the described sealing, filling and tearing off operations.

The drive means 62 can be switched off for a desired number of subsequent bags so that a length with a plurality of bags will be manufactured.

Further the drive means 40 for the forward and backward movement of the fingers 34 can be switched off so that the tearing unit 20 is not active anymore as a tearing unit and operates just as a clamping means for tightening the material web 2 over the pressure beam 26. Further the drive means 52 and 65 and the second sealing unit 24 can also be switched off so that the stretching unit 48 is switched off. Thereby the described apparatus can manufacture bags with each desired size from a continuous material web when all said units are switched off.

The invention is therefore not restricted to the above described embodiment which can be varied in a number of ways within the scope of the invention.

I claim:

1. Apparatus for packaging products in a bag of plastic material, comprising means for transporting a continuous, flat, tube-like material web having an upper layer and an under layer, along a plurality of units including in succession a first sealing unit for applying a seal between the upper and under layers of the material web, a perforating knife for making a tearing perforation in the upper and under layers of the material web seen in transport direction directly behind the seal, a tearing unit for tearing open the perforation in the upper layer of the material web, a separating unit for moving the upper layer away from the under layer at the location of the torn perforation, a filling station for filling the thus formed bag still contained in the material web with the product to be packed, a second sealing unit for applying a seal between the upper and under layers of the material web seen in transport direction directly behind the perforation, and a tearing-off unit for tearing off the filled bag of the material web, and wherein the first sealing unit comprises a sealing beam and a pressure beam, one of said beams being stationary mounted and the other beam being mounted between two pivot arms which are movable up and down by a drive means, and wherein the perforating knife is also mounted between the two pivot arms seen in transport direction in a short distance behind the movable beam.

2. Apparatus according to claim 1, wherein the tearing unit is provided with a lower beam and an upper beam movable up and down, and also movable backward and forward in transport direction.

3. Apparatus according to claim 2, wherein the backward and forward movement of the upper beam of the tearing unit can be inhibited.

4. Apparatus according to claim 3, wherein at least the facing surfaces of the lower and upper beams consist of material with a high coefficient of friction.

5. Apparatus according to claim 4, wherein the upper beam of the tearing unit comprises a plurality of fingers, each of the fingers being rotatable between an inactive position and an active position directed towards the lower beam.

6. Apparatus according to claim 5, wherein the upper beam of the tearing unit is mounted between two pivot arms, the ends of which directed away from the upper beam each are connected to a lever operable by a drive means to move the upper beam backward and forward in transport direction.

7. Apparatus according to claim 6, wherein the pivot arms of the tearing unit are coupled with the pivot arms of the first sealing unit for moving upwards said pivot arms of the tearing unit, wherein a spring is provided exerting a force directed downwards on the pivot arms of the tearing unit.

8. Apparatus according to anyone of the claim 3, wherein the lower beam of the tearing unit is mounted between two pivot arms which also carry a pressure strip at the side of the first sealing unit opposite the lower beam, said pressure strip co-operating with a pressure beam fixed to the pivot arms of the first sealing unit, wherein the pivot arms carrying the pressure strip and the lower beam of the tearing unit are adapted to pivot downward with respect to the stationary beam of the first sealing unit against the action of a spring as caused by the downward movement of the pivot arms of the first sealing unit and the pivot arms of the upper beam of the tearing unit from a position in which the upper sides of the pressure strip and the lower beam substantially lying in one plane, project above the stationary part of the first sealing unit to a position in which said upper sides ly below the upper side of said stationary part.

9. Apparatus according to claim 8, wherein at least the facing surfaces of the pressure strip and the pressure beam are covered with a material having a low coefficient of friction and a material with a high coefficient of friction, respectively.

10. Apparatus according to claim 9, wherein a U-shaped trough is mounted beside the stationary part of the first sealing unit for receiving the perforating knife during the downward movement of the pivot arms of the first sealing unit.

11. Apparatus for packaging products in a bag of plastic material, comprising means for transporting a continuous, flat, tube-like material web having an upper layer and an under layer, along a plurality of units including in succession a first sealing unit for applying a seal between the upper and under layers of the material web, a perforating knife for making a tearing perforation in the upper and under layers of the material web seen in transport direction directly behind the seal, a tearing unit for tearing open the perforation in the upper layer of the material web, a separating unit for moving the upper layer away from the under layer at the location of the torn perforation, a filling station for filling the thus formed bag will contained in the material web with the product to be packed, a second sealing unit for applying a seal between the upper and under layers of the material web seen in transport direction directly behind the perforation, and a tearing-off unit for tearing off the filled bag of the material web, and wherein the filling station is provided with a stretching unit for stretching the upper side of a bag formed in the material web and opened by the separating unit, and in that in transport direction directly behind the second sealing unit a clamping unit is mounted for clamping the stretched upper side of the bag in order to apply a seal by the second sealing unit and wherein the second sealing unit comprises a sealing beam and a pressure beam, wherein one beam is mounted stationary and the other beam is mounted on a support beam movable backward and forward and in that the clamping unit is provided with a clamping strip spring mounted on said support beam and a cooperating stationary pressure strip.

12. Apparatus according to claim 11, wherein the second sealing unit and the clamping unit are mounted together between two pivot arms movable up and down by a drive means to thus form the tearing-off unit.

13. Apparatus according to claim 12, wherein the drive means of the pivot arms of the second sealing unit and the clamping unit can be switched off.

14. Apparatus according to claim 11, wherein the stretching unit comprises two pins slidable laterally to the transport direction and mounted on a support rod movable up and down, said pins projecting into the open upper side of a bag in the lower position of the support rod and being at a distance above the upper side of a bag in the upper position of the support rod.

15. Apparatus according to claim 14, wherein the spring mounted clamping strip projects in the direction of the material web with respect to the movable beam of the second sealing unit, wherein the stretching unit carries a stop for the support beam, which stop in the lower position of the support rod blocks the movement of the support beam in the direction of the material web at a position in which the clamping strip clamps the stretched upper side of the bag on the pressure strip and the movable beam of the second sealing unit is still free from the stationary beam.

16. Apparatus according to claim 15, wherein the stop enables the further movement of the support beam in the upper position of the support rod.

17. Apparatus according to claim 13, wherein the separating unit, the stretching unit and the second sealing unit can be switched off together.

18. Apparatus for packaging products in a bag of plastic material, comprising means for transporting a continuous, flat, tube-like material web having an upper layer and an under layer, along a plurality of units including in succession a first sealing unit for applying a seal between the upper and under layers of the material web, a perforating knife for making a tearing perforation in the upper and under layers of the material web seen in transport direction directly behind the seal, a tearing unit for tearing open the perforation in the upper layer of the material web, a separating unit for moving the upper layer away from the under layer at the location of the torn perforation, a filling station for filling the thus formed bag still contained in the material web seen in transport direction directly behind the perforation, and a tearing-off unit for tearing off the filled bag of the material web, and wherein the transport means are provided with a first transport roller drivable by a motor and co-operating with a pressure roller and mounted seen in transport direction before the first sealing unit, and with a second transport roller at a distance from the first transport roller and preceding the separating unit, said second transport roller co-operating with a pressure roller and being coupled with the first transport roller with the transmission ratio 1:1, wherein the diameter of the second transport roller is large than the same of the first transport roller.

19. Apparatus according to claim 18, wherein a support roller for the material web is provided at a short distance before the second transport roller seen in transport direction, wherein a return roller adjustable in vertical direction is provided between the support roller and the second transport roller.

20. Apparatus according to claim 19, wherein the material web extends in a downward direction after the second transport roller and in that the separating unit comprises a tube extending laterally to the transport direction and connected to a source of overpressure and provided with a plurality of discharge openings distributed along the length of the tube, said tube being mounted adjacent the second transport roller and said discharge openings being directed substantially tangentially with respect to the second transport roller at the location where the material web leaves the transport roller.

21. Apparatus according to claim 20, wherein the discharge openings can be closed.

22. Apparatus according to claims 21, further comprising a control unit for controlling the motor for stepwise transporting the material web along a distance corresponding with the desired bag length.

23. Apparatus according to claim 22, wherein the desired bag length is adjustable by an adjusting means and in that the control unit determines the transported web length by measuring the angular rotation of the motor.

24. Apparatus according to claim 23, wherein a reading means is mounted between both transport rollers above the material web, which reading means provides a signal to the control unit when a print on the material web passes, wherein the control unit stops the transport of the material web in response to said signal.

25. Apparatus according to claim 24, wherein the control unit puts into operation the drive means of the pivot arms of the first sealing unit and the perforating knife after each transport of the material web along the desired bag length.

26. Apparatus according to claim 25, wherein the control unit operates the stretching unit, the clamping unit and the second sealing unit after receipt of a filling signal indicating that the formed bag has been filled and in that the control unit starts a next cycle after tearing off a bag.

* * * * *